US009180716B2

(12) United States Patent
Wang et al.

(10) Patent No.: US 9,180,716 B2
(45) Date of Patent: Nov. 10, 2015

(54) RECORDING MATERIAL

(75) Inventors: Hongqian Wang, West Lafayette, IN (US); Xiaoqi Zhou, San Diego, CA (US); David Edmondson, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/403,450

(22) PCT Filed: Jul. 9, 2012

(86) PCT No.: PCT/US2012/045905

§ 371 (c)(1),
(2), (4) Date: Nov. 24, 2014

(87) PCT Pub. No.: WO2014/011141

PCT Pub. Date: Jan. 16, 2014

(65) Prior Publication Data

US 2015/0132509 A1 May 14, 2015

(51) Int. Cl.

| | |
|---|---|
| ***B41M 5/00*** | (2006.01) |
| ***B41M 5/50*** | (2006.01) |
| *B41M 5/52* | (2006.01) |

(52) U.S. Cl.

CPC ..... *B41M 5/502* (2013.01); *B41M 5/506* (2013.01); *B41M 5/508* (2013.01); *B41M 5/0023* (2013.01); *B41M 5/5218* (2013.01); *B41M 2205/34* (2013.01); *B41M 2205/42* (2013.01)

(58) Field of Classification Search

CPC ..... B41M 5/502; B41M 5/506; B41M 5/508; B41M 5/5218

See application file for complete search history.

(56) References Cited

U.S. PATENT DOCUMENTS

| | | | | |
|---|---|---|---|---|
| 6,783,816 | B2 | 8/2004 | Golub et al. | |
| 7,371,456 | B2 | 5/2008 | Nohr et al. | |
| 7,897,203 | B2 | 3/2011 | Oriakhi et al. | |
| 8,114,487 | B2 | 2/2012 | Schultz et al. | |
| 2003/0039808 | A1 | 2/2003 | Ichinose et al. | |
| 2003/0148073 | A1 | 8/2003 | Landry-Coltrain et al. | |
| 2004/0224104 | A1 | 11/2004 | DeVries et al. | |
| 2006/0045998 | A1* | 3/2006 | Kitamura et al. | 428/32.24 |
| 2006/0286315 | A1 | 12/2006 | Hashimoto et al. | |
| 2011/0169888 | A1 | 7/2011 | Edwards et al. | |

FOREIGN PATENT DOCUMENTS

| | | |
|---|---|---|
| EP | 1321301 | 1/2007 |

* cited by examiner

*Primary Examiner* — Betelhem Shewareged
(74) *Attorney, Agent, or Firm* — Hewlett-Packard Company

(57) ABSTRACT

A printable recording material that contains an opaque supporting substrate; a resin-rich barrier layer; a coating composition with bimodal pore size distribution; and an ink colorant-receiving layer. Also disclosed herein are the method for making such material and the method for producing printed images using said printable recording material.

20 Claims, 1 Drawing Sheet

RECORDING MATERIAL

BACKGROUND

Inkjet technology has expanded its application to high-speed, commercial and industrial printing, in addition to home and office usage, because of its ability to produce economical, high quality, multi-colored prints. This technology is a non-impact printing method in which an electronic signal controls and directs droplets or a stream of ink that can be deposited on a wide variety of media substrates. These printable media or recording material can be cut sized sheets or commercial large format media such as banners and wallpapers. Current inkjet printing technology involves forcing the ink drops through small nozzles by thermal ejection, piezoelectric pressure or oscillation, onto the surface of such media. Within said printing method, the media substrate plays a key role in the overall image quality and permanence of the printed images.

Nowadays, there is a growing demand for digitally printed contents which is no longer limited to the "traditional" black-white text images and full color photo images, but extends also to prints with visual special effects such as the metallic appearance and/or reflectivity, for example. Accordingly, investigations continue into developing media and/or printing methods that can be effectively used with such printing techniques, which imparts good image quality and which allow the production of specific appearances.

BRIEF DESCRIPTION OF THE DRAWING

The accompanying drawings illustrate various embodiments of the principles described herein and are a part of the specification. The illustrated embodiments are merely examples and do not limit the scope of the claims.

DETAILED DESCRIPTION

Figure 1:
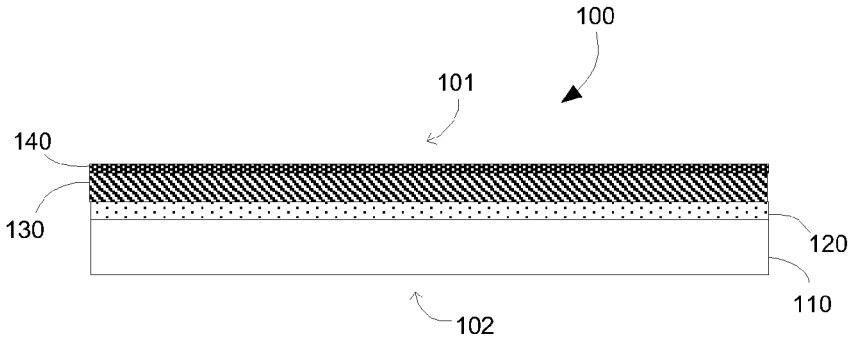
FIGS. 1 and 2 are cross-sectional views of the printable recording material according to embodiments of the present disclosure.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Thus, for example, reference to "a particle" includes reference to one or more of such materials. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percents are by weight (wt %) unless otherwise indicated. As another example, a range of 1 part to 20 parts should be interpreted to include not only the explicitly recited concentration limits of about 1 part to about 20 parts, but also to include individual concentrations such as 2 parts, 3 parts, 4 parts, etc. All parts are dry parts in unit weight, with the sum of the inorganic pigment equal to 100 parts, unless otherwise indicated.

The disclosure describes a printable recording material containing an opaque supporting substrate; a resin-rich barrier layer; a coating composition with bimodal pore size distribution; and an ink colorant-receiving layer containing inorganic particles. Also described herein is a method for making such printable recording material. The present disclosure also refers to a method for producing printed images on said printable recording material and to the resulting printed article. Said printing method enables indeed the production of printed articles with a metallic appearance and enables, for example, the creation of text and graphic prints with metallic color appearance on the printable recording material as described herein.

In some examples, the printable recording material is a printable recording medium that is able to exhibit metallic appearance when used in a printing method. In some other examples, such printable recording material is an inkjet recording material well adapted for inkjet printing device. Said material has a multilayered structure that encompasses a bottom supporting substrate and coating layers. Such combination of layers and supporting substrate forms a printable recording medium that has improved printing performances and that is able to generate images having reflective metallic appearance.

The term "ink receiving layer" refers to layer, or multiple coating layers, that are applied to a supporting substrate and which are configured to receive ink upon printing. As such, the ink receiving layers do not necessarily have to be the outermost layer, but can be a layer that is beneath other coating. Ink receiving layers might be in the form of a porous media coating or in the form of other types of media coatings such as aqueous or organic solvent swellable coatings. In some examples, the printable recording material of the present disclosure is a porous substrate that can be used in inkjet printing and that is able to generate images that combine high metallic reflectivity with an enhanced print image quality. In addition, such printable recording material has high liquid absorbing capacity. Such fast ink absorption results therefore in good print resolution, quality and edge definition.

The metallic appearance can be defined as the human perception of metal luster generated from a smooth metal surface (such as gold, copper, aluminum and chromium). In the principle described herein, the metallic appearance refers to the reflected light wave that is perceived by observer from a strong specular (directional) light reflection off the object surface. A surface appears having a metallic luster, from human perception, if it is able to reflect at specular angle greater than 10 to 20% of the incident light intensity (Highly polished smooth surface of metals elements such as gold, copper, aluminum and chromium can reflect up to 85 to 95% of incident visible light). The higher the intensity of the reflected light at specular angle is (combined with low reflection off specular angle), the stronger the metallic appearance is.

The Printable Recording Media

Figure 2:
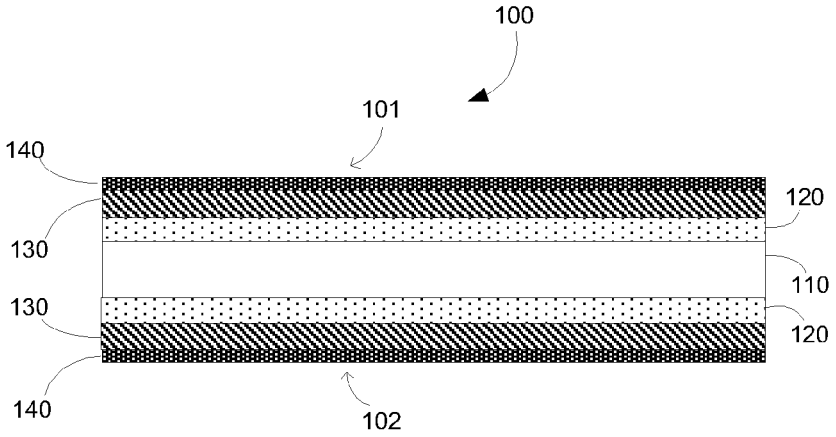

FIG. 1 and FIG. 2 illustrate embodiments the printable recording material (100) as described herein. As will be appreciated by those skilled in the art, the figures illustrate the relative positioning of the various layers of the recording media (100) without necessarily illustrating the relative thicknesses of said layers.

FIG. 1 illustrates some embodiments of the recording media (100). Such media includes a resin-rich barrier layer (120) that is applied on the image side (101) of the base substrate (110). The recording media (100) encompasses, also, a coating composition with bimodal pore size distribution (130) that is applied over the resin-rich barrier layer (120) and an ink colorant-receiving layer (140) that is deposited at the surface of the coating composition with bimodal pore size distribution (130). The supporting substrate (110) has two surfaces: a first surface that might be referred to as the "image surface" or "image side" (101), and a second surface, the opposite surface, which might be referred to as the "back surface" or "back side" (102). FIG. 1 illustrates some embodiments of the recording material (100) wherein such material includes a resin-rich barrier layer (120), a coating composition with bimodal pore size distribution (130), and an ink colorant-receiving layer (140) applied only on the image side (101) of the supporting substrate (110).

FIG. 2 illustrates some other embodiments of the recording material (100) wherein such material includes resin-rich barrier layers (120), coating compositions with bimodal pore size distribution (130) and ink colorant-receiving layers (140) that are deposited on both sides of the supporting substrate (110). Said layers are thus present on the backside (102) and on the image side (101) of the base substrate (110). FIG. 2 illustrates a double-side recording material (100) that has a sandwich structure, i.e. both sides of the supporting substrate (110) are coated with the same coating and both sides may be printed on.

Figure 3:
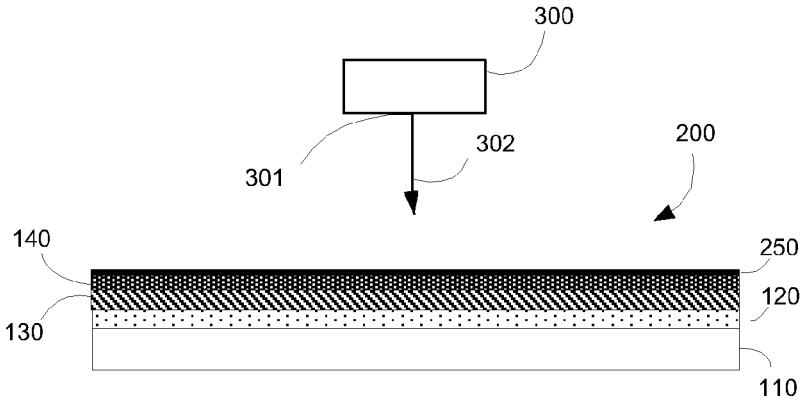
FIG. 3 is a cross-sectional view illustrating methods for producing printed articles according to some embodiments of the present disclosure.

FIG. 3 illustrates an example of printing method for forming a printed article according to the present disclosure. In such method, the printer (300) has, at least, one orifice (301) that dispenses droplets of ink composition along a trajectory (302), to the surface of the printable recording media, on the ink colorant-receiving layer (140), in view of forming a printed article (200) that encompasses a printed feature (250). In some examples, said printed feature (250) contains metal oxide particles that are retained at the surface of the ink colorant-receiving layer (140) and that form a metal oxide coating layer. The average pore size of the ink colorant-receiving layer (140) is small enough to retain practically all metal oxide particles on the surface while, in the same time, absorbing the liquid phase of the ink composition into the media.

The Supporting Substrate

In some embodiments, the recording material (100) encompasses an opaque supporting substrate (110). The supporting substrate is a base layer that provides mechanical strength and stiffness to the recording material and provides surfaces on which coatings can be formed. The terms "opaque", as used herein, refers to a material that is not transparent (but may have a uniform color, multiple colors, or particles of color) and images cannot be seen through it at all, or only slightly and not clearly. The degree of opacity could be defined as the measurement of impenetrability to electromagnetic or any other kinds of radiation, especially visible light. In some examples, the opacity of the supporting substrate (110) is greater than 80%, or greater than 85%, when measured with the TAPPI Method T 425 om-11.

The coatings, in accordance with the principles described herein, can be applied to one side or to both opposing sides of the supporting substrate. If the coated side is used as an image-receiving side, the other side, i.e. backside, may not have any coating at all, or may be coated with other chemicals (e.g. sizing agents) or coatings to meet certain needs such as to balance the curl of the final product or to improve sheet feeding in printer. The supporting substrate (110), on which coating compositions are applied, may take the form of a media sheet or a continuous web suitable for use in an inkjet printer. The supporting substrate may be a base paper manufactured from cellulose fibers. The base paper may be produced from chemical pulp, mechanical pulp or from pulps resulting from hybrid processes, such as thermo-mechanical pulp (TMP) and chemio-thermomechanical pulps (CTMP). The cellulose fibers can be made from hardwood or softwood species where hardwood fibers may have an average fiber length between about 0.5 to about 3 mm and where softwood fibers may have an average length between about 3 and about 7 mm. The ratio of hardwood to softwood fibers can range from 100:0 down to 50:50. In some examples, the hardwood to softwood fiber ratio is of about 80:20 by weight. The supporting substrate can include both cellulose fibers and synthetic fibers. The use of synthetic fiber might improve dimension stability and reduce moisture absorption when excessive aqueous ink vehicle is jetted on the receiving materials. The synthetic fibers can be made by polymerization of organic monomers. The synthetic fibers include fibers formed from polyolefins, polyamides, polyesters, polyurethanes, polycarbonates and polyacrylics. Other examples of the synthetic organic fibers made from polyolefins or polyolefin copolymers include polyethylene fibers, polyethylene copolymer fibers, polypropylene fibers, polyethylene copolymer fibers, or polypropylene copolymer fibers. Polyethylene or polypropylene copolymers may refer to the copolymers of ethylene and/or propylene with linear alkenes such as 1-butene, 1-hexene, 1-octene, 1-decene, 1-dodecene, 1-tetradecene, 1-hexadecene and 1-octadecene. Polyethylene or polypropylene copolymers can also refer to the copolymers of ethylene and/or propylene with branched alkenes, such as isobutene. Ethylene copolymer can be ethylene with vinyl acetate and with partial or complete hydrolysis products, such as polyvinyl alcohol fibers. In some examples, the content of the synthetic fiber is from about 3 to about 50 wt % of the total fiber weight or could be in the range of about 5 to about 20 wt % of total fiber weight.

The supporting substrate (110) can include additives such as internal sizing agents and fillers. Without being linked by any theory, the internal sizing agent may provide hydrophobicity to the base and fillers may contribute to a higher opacity. The paper base can contain fillers in an amount representing from about 5% to about 50% by total weight of the raw base. As a non-limiting example, the fillers may be selected from calcium carbonate, talc, clay, kaolin, titanium dioxide and combinations thereof. In some examples, the supporting substrate includes $TiO_2$ particles as inorganic fillers in order to improve opacity.

The supporting substrate (110) can include inorganic fillers in an amount representing from about 8 wt % to about wt 40% by total weight of the supporting substrate, or in an amount ranging from about 10 wt % to about wt 30%. In some examples, the inorganic fillers is a mixture of calcium carbonate and $TiO_2$ particles and is present in an amount representing more than about 15 wt % by total weight of the supporting substrate. Said mixture of calcium carbonate and $TiO_2$ particles has a weight percentage of about 5 wt % to about 30 wt % of fillers per total weight of the mixture.

The supporting substrate (110) can have a base weight ranging from about 90 to about 300 grams/meter$^2$ (gsm), or can have a base weight ranging from about 100 to about 220 gsm.

The Resin-Rich Barrier Layer

The printable recording material (100) encompasses a resin-rich barrier layer (120) that is applied on top of the supporting substrate (110). Said barrier layer (120) is deposited on, at least, one side of the base substrate (110) or on both sides of the supporting substrate (110). Without being linked by any theory, it is believed that said layer (120) helps to avoid excessive absorption of aqueous solvents into the media substrate (110). Indeed, inkjet ink contains large amount of aqueous solvents, mostly water. When such ink is applied on the receiving media, the excessive aqueous solvent can be absorbed into the substrate and cause cellulose fiber swelling. This effect may cause adverse paper cockling and destroy paper smoothness which, in turn, reduces light reflectance.

In some examples, the resin-rich barrier layer (120) creates a smooth surface and high gloss surface (i.e. superior to 80 gloss unite at 75 degree observation angle). The resin-rich barrier layers (120) can be a single layer, or a multiple layers.

The resin-rich barrier layer can be considered as resin-rich pigmented coating layer that reduce the penetration of exterior moisture into the substrate. The barrier layer can include one or more types of pigment particles and polymer resin binders. The resin-rich barrier layer may include polymer resin binder in amounts that represent, at least, 10 wt % of the total pigment fillers. In some example, the barrier layer includes from about 30 to about 80 wt % of polymer resin binder by total weight of barrier layer (120). In some other example, the barrier layer includes from about 40 to about 70 wt % of resins by total weight of barrier layer. The polymer resins act, both, to hold pigments together and as a moisture barrier that prevents moisture absorption from environment. A wide variety of resin binder compositions can be used in the barrier layer. Such resin binder compositions may include, but are not limited to, resins formed by polymerization of hydrophobic addition monomers. Examples of hydrophobic addition monomers include, but are not limited to, $C_1$-$C_{12}$ alkyl acrylate and methacrylate (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl arylate, methyl methacrylate, ethyl methacrylate, n-propyl methacrylate, isopropyl methacrylate, n-butyl methacrylate, isobutyl methacrylate, sec-butyl methacrylate, tert-butyl methacrylate), and aromatic monomers (e.g., styrene, phenyl methacrylate, o-tolyl methacrylate, m-tolyl methacrylate, p-tolyl methacrylate, benzyl methacrylate), hydroxyl containing monomers (e.g., hydroxyethylacrylate, hydroxyethylmethacrylate), carboxylic containing monomers (e.g., acrylic acid, methacrylic acid), vinyl ester monomers (e.g., vinyl acetate, vinyl propionate, vinylbenzoate, vinylpivalate, vinyl-2-ethylhexanoate, vinylversatate), vinyl benzene monomer, $C_1$-$C_{12}$ alkyl acrylamide and methacrylamide (e.g., t-butyl acrylamide, sec-butyl acrylamide, N,N-dimethylacrylamide), crosslinking monomers (e.g., divinyl benzene, ethyleneglycol dimethacrylate, bis(acryloylamido)methylene), and combinations thereof. In some examples, the glass transition temperature of the polymer resin binder ranges from about 20° to about 80° C. In some embodiments, the resins are formed by hydrophobic polymerization of monomers of $C_3$-$C_{12}$ alkyl acrylate and methacrylate.

The polymers can be made using a wide variety of polymerization methods such as bulk polymerization, solution polymerization, emulsion polymerization, or other suitable methods. In some examples, the resins are made from emulsion polymerization using the monomers described above and can be in the form of emulsion or latex. The emulsion polymerization, in the presence of aqueous solvent such as water, may be useful in making the polymer resins described above. Polymer resin binders can be made using emulsion polymerization with a particle size ranging from 0.1 to 5 micrometers or ranging from 0.5 to 3 micrometers.

The resin can be polymers of olefin monomers and comonomers (alkene with the general formula $C_nH_{2n}$). The polymerization process can be radical polymerization, anionic addition polymerization, ion coordination polymerization or cationic addition polymerization, for example, coordination polymerization via Phillips and Ziegler-type catalysts and metallocenes type of catalysts.

Inorganic pigments can also be present in resin-rich barrier layer (120). The inorganic pigments can have a mean size ranging from about 0.2 micrometers to about 1.5 micrometers (μm). These inorganic pigments can be in a powder or slurry form. Examples include, but are not limited to, titanium dioxide, hydrated alumina, calcium carbonate, barium sulfate, silica, clays (such as high brightness kaolin clays), and zinc oxide. The resin-rich barrier layer can contain calcium carbonate.

The resin-rich barrier layers (120) can be deposited on both sides of the base substrate (110). In some examples, the coat weight of the resin-rich barrier layer ranges from about 0.01 to about 20 grams/meter$^2$ (gsm). In some other examples, the coat weight of the resin-rich barrier layer is from about 0.2 to about 5 grams/meter$^2$ (gsm). The resin-rich barrier layer can be applied onto the substrate by aqueous and/or solvent liquid paper coating methods such as rod coating, blade coating, film transfer coating, air knife coating, slot die coating and/or curtain coating. The resin-rich barrier layer can also be applied onto the substrate in a form of melt by a heated extrusion method with a coat weight ranging from about 0.5 to about 20 gsm.

The Coating Composition with Bimodal Pore Size Distribution

The printable recording material (100) of the present disclosure encompasses a coating composition with bimodal pore size distribution (130). Said coating composition is a porous coating composition.

By "bimodal pore size distribution", it is meant herein that the coating composition encompasses large pore size as well as small pore size. The bimodal pore size distribution refers to the plotting of percentage pore volume vs. pore diameter, which are measured by a pore size tester (such as AutoPore Automated Mercury Porosimeter, supplied by Micrometrics Inc.), when the plots shows a continuous probability distribution with two different modes, it appear as at least two distinct peaks (local maxima) (in the probability the pore volume functions with pore size as the variable). The bimodal pore size distribution can also be measured by a mercury porosimeter where the pore size diameter is plotted against log differential intrusion of mercury (mL/g).

The coating composition with bimodal pore size distribution can have thus a pore size distribution with two clear maxima corresponding to small pores (centered at around 5 to 50 nm) and larger pores (centered at around 100 to 600 nm), for example.

Without being linked by any theory, it is believed that said coating composition with bimodal pore size distribution (130) can form a ink receiving layer which has the capability to absorb ink vehicle quickly so that ink bleeding or coalescence can be minimized, and has the ink capacity which is able to hoard the aqueous ink vehicle to yield to a fast drying printing medium. In addition, the coating composition with bimodal pore size distribution (130) provides a smooth media surface that enhances incident light reflection and therefore, enhances metallic appearance when metallic ink is applied to the recording medium.

The coating composition with bimodal pore size distribution (130) encompasses a primary permanently positive charged particles; a secondary permanently positive charged particles; a metallic salt; and a binder.

The composition presents a bimodal pore size distribution with at least two distinct peaks. It is believed that the primary permanently positive charged particles provides a first distinct peak, at the range of large pore size, while the secondary permanently positive charged particles contributes to a second distinct peak, at the range of small pore size. If the two distribution peaks are close or overlapped, smaller particles tends to act as a "filler" for the porous structure of larger particles and porosity of the media is reduced. Without being linked by any theory, it can be said that the surface charge of media filler particles is different in inkjet printing by comparison to other printing technologies. For inkjet ink receiving media, it is desirable to fill with a positive charged particle (as ink colorants are negatively dispersed particles). When filler particles are jetted on a positive charged media surface, by electrostatic interaction, the ink colorant is thus subjected to stronger interaction with the media surface. Such interaction plays an important role to the image quality and durability.

In some examples, the primary permanently positive charged particles are permanently positive charged clay particles (i.e. reversed charged clay particles).

Clay surface is, traditionally, negative charged, arising either directly from Al(III) substitution for Si(IV) in the tetrahedral sheet of the mineral, or indirectly from isomorphic substitutions in 2:1 layer type clay mineral inclusions (Clays and Clay Minerals, Vol. 45, No. 1, 85-91, 1997).

The reverse charge of the clays is carried out in an acidic environment with the use of a reverse charge agent that can be an organosilane or mixture of organosilanes having the structure: $(RO)_3SiR'$—N wherein R and R' are any chemical group selected from the group consisting of alkyl groups, aromatic groups and hetero-aromatic groups. In some examples, the RO groups are hydrolysable in neutral to acidic condition. Examples of RO group include methoxy, ethoxy, alkoxy or acetoxy group. N is a group which can be converted into a cationic charged function group. Examples of N groups are nitrogen containing groups, such as but not limited to, carboxamides —CO—$NH_2$; primary amine —$RNH_2$; secondary amine $R_2NH$; tertiary amine $R_3N$ and pyridines; —$RC_5H_4N$ which can convert to cationic pyridinium, like 4-pyridyl, 3-pyridyl and 2-pyridyl. In some examples, N groups are nitrogen containing various levels of substituted amines.

During clay reverse charging, it is believed that the RO groups (such as for examples, alkoxy group) of the organosilane is, firstly, hydrolyzed in the acidic condition and forms silanols, either through the addition of water or from residual water on the inorganic surface. The silanols coordinate with metal hydroxyl groups on clay surface to form an oxane bond and eliminate water. This reaction makes one side of reverse charge agent chemical bonded on the clay surface permanently. The second reaction, during reverse charge processing, is to convert neutral charged nitrogen atom in N groups of reverse charging agent into positive charged $N^+$ cations in acidic condition where a $H^+$ is added onto the central N and forms $N^+$. These two reactions convert the anionic charged clay surface into cationic charged surface and disperse clay dry particles into stable slurry under the shearing action of reverse charge processing. Porous clay powder is reverse charged under shear force in aqueous solvent, like water. The PH can be maintained in the range of about 3.0 to about 5.0 by adding diluted HCl.

The degree of charge reversing on clay surface is monitored by measuring Z-potential of aqueous slurry using a Zeta potential instrument. In some examples, the Z-potential on clay surface is in the range of about 5 to about 35 mV and, in some other examples, is in the range of about 15 to about 25 mV. In some examples, the positive charged clay particles that are part of the coating composition with bimodal pore size distribution (130), have a particle size in the range of about 0.2 to about 1.5 micrometers (μm), or in some other example in the range of about 0.1 to about 1.0 micrometers (μm).

In some examples, the coating composition with bimodal pore size distribution (130) encompasses primary permanently positive charged clay particles. In some other examples, the coating composition with bimodal pore size distribution, that encompasses primary permanently positive charged clay particles, have a first peak, in the range of about 100 to about 600 nanometers (nm) and a second peak, is in the range of about 10 to about 40 nanometers (nm).

Reverse charged clay slurry can further be modified with metallic salts. In some examples, the coating composition with bimodal pore size distribution (130) encompasses metallic salts, including water-soluble or water-dispersible metallic salts. The metallic salts can be mono- or multi-valent metallic salts. In some examples, the metallic salts are multivalent metallic salts. The metallic salt may include cations, such as Group I metals, Group II metals, Group III metals, or transition metals, such as sodium, calcium, copper, nickel, magnesium, zinc, barium, iron, aluminum and chromium ions. An anion species can be chloride, iodide, bromide, nitrate, sulfate, sulfite, phosphate, chlorate, acetate ions and other organic anions, or various combinations. The modification of the clays can be carried out during reverse charge by adding metallic salt into reverse charging agents, or set as a stand-alone processing by mixing the metallic salts into the reverse charged clay. After treatment, such clay suspension can be filled with metallic cationic ions. These ions mainly exist as free unbounded cations. Once the ink vehicle wets the media surface, these free metallic cations are able to react quickly with anionic colorants in ink formulation.

The coating composition with bimodal pore size distribution (130) further encompasses a second type of the pigment particles. In some examples, the secondary permanently positive charged particles are any inorganic particles with an aggraded particle size in the range of about 10 to about 150 nanometers (nm). Said secondary positive charged particles are permanently positive charged.

In some examples, the surface area of the second type of pigment particles is not smaller than 100 $m^2/g$, or not smaller than 150 $m^2/g$. In some other examples, the second type of pigment particles is permanently positive charged silica particles. Examples of such pigment particles are silica and fumed silica such as Cab-O-sil® MS-55 (available from Cabot Ltd), Orisil® 200, Orisil® 250 and Orisil® 300 (available from Orisil Ltd). In some examples, the silica particles are pretreated with high valence metallic salt, such as aluminum chloride hydrate (ACH) to form a cationic charged surface. The silica particles can also be pretreated by other method such as the one using polyethyleneimines and polyhexamethylene biguanide (PHMB).

In some embodiments, the coating composition (130) encompasses a binder. Said binder can adhere to the pigment particle to form an integrated layer. To be compatible with cationic charged primary and secondary pigment particles, binders can be either cationic charged or neutral charged, natural or synthetically compounds. Examples of binders include cationic or neutral charged acrylic latex, SBR latex (styrene-butadiene rubber latex), polyvinyl alcohol, polyvinyl-polypyrrolidone and virgin or chemical modified starches.

In some examples, the binders can be water soluble binders, water dispersible polymers or polymeric emulsions that exhibit high binding power for base paper stock and pigments, alone or as a combination. The amount of binder in the coating composition with bimodal pore size distribution (130) may be in the range of about 5 parts to 20 parts based on 100 parts of primary and secondary pigment particles. Such binders can be homopolymer and/or copolymer of polyvinyl alcohol polyvinylpyrrolidone and polyacrylate. The copolymers can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate or methyl vinylketone. The polymers and copolymers can have an average molecular weight ranging from about 10,000 Mw to about 1,000,000 Mw or can have an average molecular weight ranging from about 20,000 Mw to about 500,000 Mw. In some examples, the binder is a polyvinylalcohol having a molecular weight in the range of about 20,000 to about 500,000.

In some examples, the permanent "cationic activation center" existing on the two types of particles can be different in terms of chemical structure. For example, the primary reverse charged clay can have a cationic activation centre formed by coordinating silanols with metal hydroxyl groups, on clay surface, to form an oxane bond and eliminate water, and then convert neutral charged nitrogen atom in N groups of reverse charging agent into positive charged $N^+$ cations in acidic condition where a $H^+$ is added onto the central N and forms $N^+$. In comparison with cationic activation center in the primary pigment particles, the permanent positive charge of secondary pigment particles, like silica nano particles, is accomplished by aluminum chloride where cationic activation center is $Al^{3+}$. Even through the existing of different chemical structures, when two types of pigment particles are made into dispersion, the final Z-potential of two kinds of particles in the dispersion are similar to avoid any incompatibility issues such as gelling. In some examples, difference of Z-potential is within the range of 15 millivolts.

The Zeta potential is defined as the potential across the interface of solids and liquids, and more specifically, the potential across the diffuse layer of ions surrounding a charged colloidal particle which is largely responsible for colloidal stability. Zeta potentials can be calculated from electrophoretic mobility, namely, the rates at which colloidal particles travel between charged electrodes placed in the dispersion, emulsion or suspension containing the colloidal particles, and can be also measured under fixed pH value using a Zeta Sizer. This can be carried out by diluting 1 or 2 drops of the dispersion in 100 ml of deionized water and adjusting the pH to a constant value.

It is believed that the bimodal pore size distribution provides adequate ink capacity and ink vehicle absorption rate, while, in the same time, contribute to a good formation of metal oxide film at the surface of the media. Indeed, it is believed that an uniform distribution of larger pore size provide adequate ink capacity and ink vehicle absorption rate to overcoming the potential ink bleed, whereas the smaller pore size (which is in the same order of metal oxide particles present in the ink composition) contribute to a good formation of metal oxide film.

The Ink Colorant-Receiving Layer

An ink colorant-receiving layer (140) is applied on top of the coating composition with bimodal pore size distribution (130); said ink colorant-receiving layer encompasses inorganic particles. Without being bounded by any theory, it is believed that the ink colorant-receiving layer (140) plays dual functions. One function is to form a physical barrier layer which constraints most of metallic ink colorant particles at the outmost surface, while its specific packed pore size can provide capillary force and flow path to allow the ink vehicle penetrating into the coating composition with bimodal pore size distribution (130). The "packed pore size" refers to the average pore size as measured by Mercury Porosimeter on the coated surface after it is solidified.

The average pore size of the ink colorant-receiving layer (140) is smaller than the average pore size of the coating composition with bimodal pore size distribution (130) in view of retaining the metal oxide particles of the ink on media surface. In some examples, the ink colorant-receiving layer (140) has an average pore size that is less than 50 nm; in some other examples, that is less than 30 nm. The thickness of the ink colorant-receiving layer (140) can be in the range of about 100 nm and about 600 nm.

In some examples, the ink colorant-receiving layer (140) encompasses inorganic particles having a refractive index (n) superior or equal to 1.65. In some other examples, the refractive index (n), of the inorganic particles, is in the range of about 1.7 to about 2.5. In yet some other example, the refractive index (n) is between about 1.2 and about 1.8. The refractive index, or index of refraction, of the inorganic particles is the measure of the speed of light in metal oxide particles. It is expressed as a ratio of the speed of light in vacuum relative to that in the particles medium.

The inorganic particles can be metal oxides or complex metal oxides particles. As used herein, the term "metal oxide particles" encompasses metal oxide particles or insoluble metal salt particles. Metal oxide particles are particles of metal oxide that have high refractive index (i.e. more than 1.65) and that have particle size in the nano-range such that they are substantially transparent to the naked eye. In some examples, the metal oxide particles are either colorless or have rather weak coloration in thin layers. In some examples, the average size of the oxide particles is smaller than ¼ wavelengths (¼λ) of the visible wavelength. The visible wavelength is ranging from about 400 to about 700 nm. Therefore, the average size of the metal oxide particles is between about 3 and about 180 nm or may also be between about 5 and about 150 nm. In some examples, the average size of the metal oxide particles is between about 10 and about 100.

Non limiting examples of inorganic particles, that are part of the ink colorant-receiving layer (140), are white or colorless materials such as aluminum oxide, aluminum phosphate, nanocrystalline boehmite alumina (AlO(OH)), beryllium oxide, dysprosium oxide hafnium(IV) oxide, lutetium oxide, scandium oxide, tantalum pentoxide, tellurium dioxide, titanium dioxide, zinc oxide, zirconium dioxide, barium titanate calcium molybdate, calcium tungstate, gallium arsenide oxide, gallium antimonide, oxide potassium niobate, potassium tantalate, potassium titanyl phosphate, lithium iodate, lithium niobate, silicon dioxide, strontium titanate, yttrium aluminium garnet or yttrium vanadate.

In some examples, the ink colorant-receiving layer (140) contains inorganic particles that can be selected from the group consisting of aluminum oxide ($Al_2O_3$), silicon dioxide ($SiO_2$), nanocrystalline boehmite alumina (AlO(OH)) and aluminum phosphate ($AlPO_4$). In some other examples, the ink colorant-receiving layer (140) contains aluminum oxide ($Al_2O_3$) or silicon dioxide ($SiO_2$). In yet some other examples, the ink colorant-receiving layer (140) contains aluminum oxide ($Al_2O_3$).

The ink colorant-receiving layer (140) may also contain a binder that can be independently selected from the binders present in the coating composition with bimodal pore size distribution (130).

The ink colorant-receiving layer (140) can be formed with variety of suitable coating methods, such as: blade coating, air knife coating, metering rod coating, film transfer coating, slot die coating, curtain coating, pressure jetting coating, thermal jetting coating, spray coating or another suitable technique. It can be also formed by other deposition techniques such as plasma deposition, sputtering deposition, and electron beam deposition. In some embodiments, the ink colorant-receiving layer (140) is applied over the coating composition with bimodal pore size distribution (130) with a coating weight of about 0.01 to about 5 gsm, or with a coating weight of about 0.1 to about 2 gsm.

Method for Making the Printable Media

A method of making the printable recording media (100), such as defined above, includes providing an opaque supporting substrate; applying a resin-rich barrier layer (120) onto said opaque supporting substrate (110); applying a coating composition with bimodal pore size distribution (130) and depositing an ink colorant-receiving layer (140), containing inorganic particles, on top of said layers; then drying and calendaring the layers. The resin-rich barrier layer (120), the coating composition with bimodal pore size distribution (130) and the ink colorant-receiving layer (140) can be coated onto the supporting substrate (110) via any coating techniques, followed by any drying techniques. Methods of application may include, but are not limited to, curtain coating, cascade coating, fountain coating, slide coating, slot coating, blade coating, rod coating, air-knife coating, size-press (including puddle and metered size press), or hopper coating.

The coating composition with bimodal pore size distribution (130) can be formed with variety of suitable coating methods, such as: blade coating, air knife coating, metering rod coating, film transfer coating, slot die coating, curtain coating, pressure jetting coating, thermal jetting coating, spray coating or another suitable technique. In some examples, the coating composition with bimodal pore size distribution (130) is applied with a coating weight of about 2 to about 40 gsm, and, in some other examples, is applied with a coating weight of about 5 to about 25 gsm.

Method for Producing Printed Images

In some examples, a method for forming printed images on the printable recording material described above include: obtaining a printable recording material (100) containing an opaque supporting substrate (110); a resin-rich barrier layer (120); an coating composition with bimodal pore size distribution (130); and an ink colorant-receiving layer (140) containing inorganic particles (140); then providing an ink composition and applying said ink composition onto said recording material, to form a printed image.

The method for forming printed images can be done by means of digital printing technology. In some examples, the ink composition is applied by projecting a stream of droplets of ink composition onto the printable recording material, via inkjet printing technique. The ink composition may be established on the printable recording medium via any suitable inkjet printing technique. Non-limitative examples of such inkjet printing technique include thermal, acoustic, continuous and piezoelectric inkjet printing. In some examples, the ink compositions used herein are inkjet compositions; it is meant thus that said ink compositions are well adapted to be used in an inkjet device and/or in an inkjet printing process.

By inkjet printing technique, it is meant herein that the ink is applied using inkjet printing devices. Within inkjet printing devices, liquid ink drops are applied in a controlled fashion to a print medium by ejecting ink droplets from a plurality of nozzles, or orifices, in a printhead of an inkjet printing device or inkjet printer. In some examples, ink compositions may be dispensed from any piezoelectric or drop-on-demand inkjet printing devices. Such inkjet printing devices can be available from Hewlett-Packard Inc. (Palo Alto, Calif., USA) by way of illustration and not limitation. In drop-on-demand systems, a droplet of ink is ejected from an orifice directly to a position on the surface of a print medium by pressure created by, for example, a piezoelectric device, an acoustic device, or a thermal process controlled in accordance digital data signals. An ink droplet is not generated and ejected through the orifices of the printhead unless it is needed. The volume of the ejected ink drop is controlled mainly with a printhead. The printed or jetted ink may be dried after jetting the ink composition in a predetermined pattern onto a surface of a print medium. When present, the drying stage may be conducted, by way of illustration and not limitation, by hot air, electrical heater or light irradiation (e.g., IR lamps), or a combination of such drying methods. In order to achieve best performance it is advisable to dry the ink at a maximum temperature allowable by the print medium that enables good image quality without print medium deformation. In some examples, a temperature during drying is about 40° C. to about 150° C.

The ink composition, referred herein, may encompass one or more colorants that impart the desired color to the printed message. As used herein, "colorant" includes dyes, pigments and/or other particulates that may be suspended or dissolved in an ink vehicle. In some other examples, the ink composition includes pigments as colorants. Pigments that can be used include self-dispersed pigments and non self-dispersed pigments. Pigments can be organic or inorganic particles. Such pigments are commercially available from vendors such as Cabot Corporation, Columbian Chemicals Company, Evonik, Mitsubishi, and DuPont de Nemours and can be colored pigments, such as, for examples, cyan, magenta, yellow, blue, orange, red, green, pink or black pigments.

In some examples, the ink composition is a metalized ink composition and encompasses dispersed metal oxide particles. The "metal oxide particles" are particles that have particle size in the range such that they are substantially transparent to the naked eye. Said metal oxide particles have an average particle size in the range of about 3 to about 300 nm, or in the range of about 10 to about 100 nm. The metal oxide particles can have an average particle size in the range of about 10 to about 50 nm, or in the range of about 20 to about 30 nm. Metal oxide particles include metal oxide pigments selected from the group consisting of titanium dioxide ($TiO_2$), in rutile or anatase crystalline form, zinc oxide (ZnO), indium oxide ($In_2O_3$), manganese oxide ($Mn_3O_4$) and iron oxide ($Fe_3O_4$). In some examples, the metal oxide particles are iron oxide ($Fe_3O_4$) or manganese oxide ($Mn_3O_4$) particles. The ink composition can contain iron oxide ($Fe_3O_4$) as metal oxide particles.

Metal oxide particles contained in the ink compositions may have a refractive index (n) that is different from the refractive index of the inorganic particles present in the ink colorant-receiving layer (140). In fact, the bigger the differences in the refractive index (n) are, the better the reflectivity of the printed article is.

In some examples, the ink composition is an inkjet ink composition that contains, at least, metal oxide particles and an aqueous carrier. In some other examples, the ink composition contains a metal oxide, a dispersant and a liquid vehicle. The amount of the metal oxide particles can represent from about 0.1 to about 10 wt % of the total weight of the ink composition. Examples of suitable dispersants include, but are not limited to, water-soluble anionic species of low and high molecular weight such as phosphates and polyphosphates, phosphonates and polyphosphonates, phosphinates and polyphosphinates, carboxylates (for example, citric acid or oleic acid), polycarboxylates (for example, acrylates and methacrylates), hydrolysable alkoxysilanes with alkoxy group attached to water-soluble (hydrophilic) moieties such as water-soluble polyether oligomer chains (for example, polyether alkoxysilanes). In some examples, the dispersant is a polyether alkoxysilane dispersant.

The ink compositions described herein contains colorant or metal oxide particles that are dispersed in a liquid vehicle or liquid carrier. "Liquid vehicle" is defined to include any liquid composition that is used to carry metal oxide particles or pigments to the substrate. Such liquid vehicles may include a mixture of a variety of different agents, including without limitation, surfactants, solvents and co-solvents, buffers, biocides, viscosity modifiers, sequestering agents, stabilizing agents and water. Though not liquid per se, the liquid vehicle can also carry other solids, such as polymers, UV curable materials, plasticizers, salts, etc.

The Printed Article

The printing method that encompass obtaining a printable recording material (100) containing an opaque supporting substrate (110); a resin-rich barrier layer (120); coating composition with bimodal pore size distribution (130); and an ink colorant-receiving layer (140); providing an ink composition; and applying said ink composition onto said recording material, results in a printed article with enhanced image quality and enhanced absorption performances. Such as illustrated in FIG. 3, the printed article (200) encompasses thus a printable recording material (100) containing an opaque supporting substrate (110), a resin-rich barrier layer (120), a coating composition with bimodal pore size distribution (130), and an ink colorant-receiving layer (140) with inorganic particles; and a printed feature (250) applied on top of said printable recording material.

In some examples, when the ink composition encompasses metal oxide particles with an average particle size in the range of about 3 to about 300 nm, said method results in prints with strong "metallic" appearance and high print quality/sharp details resolution. The jetting of the ink composition, that contains metal oxide particles, result in printed articles (200) with metallic color appearance and metallic luster. The resulting printed article can have a uniform coating with strong sparkling and metallic reflective appearance. By "metallic luster", it is meant herein that the printed article has an opaque or a semi-opaque appearance and reflects the light as a metal reflects it. The printed article interacts with the light and has a shiny metal appearance. The printed article has, thus, specific optical properties: it exhibits a sort of glow from reflected light and has the tendency to reflect at specular angle when exposed to directional light source. In some examples, the printed article has a gold appearance. By "gold-like appearance", it is meant herein that the printed article has a visual appearance of gold-plated surface and has the color of metallic gold (Au). However, the printed article does not contain any gold or other elemental metal particles. The printed article exhibits thus gloss and sheen as a gold object does.

For optimum metallic appearance, the printed article (200) encompasses a printed feature (250) that can be considered as a metal oxide coating layer. Said printed feature can contain metal oxide particles that are presents in the metalized ink composition. In some examples, the printed feature (250) is a metal oxide coating layer.

Said printed feature can be a planarized optically reflective layer that encompasses metal oxide particulates, with a thickness that is in the range of about 1 to about 600 nm, or, between about 3 to about 300 nm. The metal oxide coating layer can have a density in the range about 3 to about 80 $\mu g/cm^2$ or a density in the range of about 10 to about 40 $\mu g/cm^2$. Said metal oxide layer can be optically transparent or semi-transparent.

The printed article can be useful for forming printed images that have, for examples, decorative applications, such as greeting cards, scrapbooks, brochures, book covers, signboards, business cards, certificates, interior design, stunning portraits, various package and other like applications. In some other examples, such printed article can be used as printed media used in printing techniques.

The preceding description has been presented to illustrate and describe some embodiments of the present invention. However, it is to be understood that the following are only illustrative of the application of the principles of the present recording material and methods.

Ingredients:

Hydrocab®H60 is corse $CaCo_3$ slurry available from Omya Inc.

Pluronic®L61 is surfactant available from BASF.

Dynwet®800 is a surfactant available from BYK Inc.

Ansilex®93 is calcined clay supplied by BASF.

Aerosil®200 is hydrophilic fumed silica supplied by Evonik Degussa Corporation.

Mowiol®40-88 is polyvinyl alcohol (PVA) binder available from Kurraray.

Zonyl FS-300 is a surfactant available from DuPont

Silwet®L7605 is a polydimethylsiloxane methylethoxylate available from Momentive Inc.

Disperal® HP 14 is a dispersible alumina nanoparticles manufactured by Sasol Co.

LEG-1 is a branched ethylene glycol available from Liponics Technologies.

Proxel®GXL is a biocide available from Arch Chemicals.

Surfynol 465 is a surfactant from Air Products and Chemicals Inc.

Dantocol® DHE is a crosslinking agent available from Lonza.

Trizma® Base is a solvent available from Sigma-Aldrich.

Rovene®4040 is a polymer binder available from Mallard Creek Polymers Inc.

BYK®024 is a defoamer available from BYK Inc.

EXAMPLE 1

Supporting Substrate (110)

The supporting substrate (110) is made in a pilot paper machine with a pulp containing about 70 wt % of cellulose fibers, about 22 wt % of inorganic fillers and about 8 wt % of processing additives (including PH and retention control agent; alkyl ketene dimer (AKD) as internal sizing agent; cationic starch as wet strength agent; cationic polyacrylamide as retention control agent; and other functional chemicals, such as colorant (basic dyes) and di-sulfonated optical brightness agent). The cellulose fiber contains about 80 wt % of hardwood and about 20 wt % of softwood. The filler composition contains about 80% of precipitated calcium carbonate and about 20 wt % of $TiO_2$ in the pulp furnish. The basis weight of the supporting substrate is 220 gsm.

EXAMPLE 2

Resin-Rich Barrier Layer (120)

A resin-rich barrier layer (120) is prepared in view of being applied on the supporting base substrate (110) using a pilot coater equipped with a smooth Meyer rod with a coating weight of about 5 gsm/side. The resin is a SBR emulsion containing about 45 wt % solids (diluted to 15 wt % when applied) and having a glass transition temperature of about 50° C. The barrier layer (120) further contains surfactants (Pluronic®L61 and Dynwet®800) and defoamer (BYK®024) in an amount representing about 2.4 wt % of the total weight of the layer. Calcium carbonate filler is also added. TABLE A illustrates the formulation of the resin-rich barrier layer (120). All numbers are expressed in parts by weight.

TABLE A

| Resin-rich barrier layer (120) | Parts per weight |
|---|---|
| Rovene ® 4040 | 52 |
| Hydrocarb ® H60 | 100 |
| Plurnoic ® L61 | 0.7 |
| Dynwet ® 800 | 0.8 |
| BYK ® 024 | 0.6 |

EXAMPLE 3

The Coating Composition with Bimodal Pore Size Distribution (130)

Calcined clay (Ansilex®93) is treated with different reversing charge agents in view of obtaining reversed charged clay (i) to (vii). Reversed charged clay (vi) and (vii) are comparative examples. A block copolymer surfactant (Pluronic®L61) is added to adjust surface tension. The reversed charged clays (i) to (vii) are listed in the TABLE B. All numbers are parts by weight.

TABLE B

| | Reversed charged clay | | | | | | |
|---|---|---|---|---|---|---|---|
| | (i) | (ii) | (iii) | (iv) | (v) | (vi) Comp. | (vii) Comp. |
| Ansilex ®93 | 100 | 100 | 100 | 100 | 100 | 100 | 100 |
| Pluronic ®L61 | 0.5 | 0.5 | 0.5 | 0.5 | 0.5 | 0.5 | 0.5 |
| Reversing charge agent | | | | | | | |
| 3-Aminopropyltriethoxysilane | 5 | — | — | — | — | — | — |
| Aminoethylaminopropylsilane triol homopolymer | — | 5 | — | — | — | — | — |
| Di-amine propyltriethoxysilane | — | — | 5 | — | — | — | — |
| vinylbenzylamine propyltriethoxysilane | — | — | — | 5 | — | — | — |
| N-(n-Butyl)-3-aminopropyltrimethoxysilane | — | — | — | — | 5 | — | — |
| polyhexamethylene biguanide | — | — | — | — | — | 5 | — |
| Z-potential (in mV) | 21.8 | 17.3 | 23.2 | 20.5 | 21.2 | 40.7 | −37.5 |

The Z-potential (in mV) of the reversed charge clay (i) is measured at different pH at a temperature of 23.4° C. The Z-potential (in mV) of the reversed charge clay is dependent of the pH as illustrated in Table C below.

TABLE C

| pH of the reversed charge clay (i) | Z-potential (mV) |
|---|---|
| 2.8 | 51.5 |
| 4.02 | 54.2 |
| 5.17 | 48.5 |
| 6.13 | 47.2 |
| 7.11 | 34.5 |
| 8.05 | 23.5 |

Fumed silica particles (AerosilL®200) are treated in water suspension with aluminum trichloride (ratio by weight: 100/3) at room temperature using a high shear mixer (Kady mixer) for 30 min. The dispersion is then moved to another container and mixed at 65° C. for 70 min using a blade mixer. The solid content of the final dispersion is 30 about wt %. The pH of this composition is between 4.5 and 5.5.

The coating composition with bimodal pore size distribution (130) is made by using the charge reversed clay (i) as illustrated in TABLE B and with other ingredient according to the formulation listed in TABLE D below. The mixing is carried at room temperature using a blade mixer for 15 min. The formulation of the coating composition with bimodal pore size distribution (130) is illustrated in table D below. All numbers are expressed in parts by weight.

TABLE D

| Coating layer (130) formulation | Amount by weight parts |
|---|---|
| Reversed charged clay (i) | 100 |
| Aerosil ® 200 (at 30 wt %) | 35.00 |
| $CaCl_2$ | 5.00 |
| Mowiol ® 40-88 | 15.00 |

EXAMPLE 4

Ink Colorant-Receiving Layer Comprising Inorganic Particles (140)

The ink vehicle receiving layer (140) is prepared in accordance with the formula such as illustrated in the TABLE E below. High refractive alumina nano-particles (Disperal®HP-14) are treated using acetic acid and potassium chloride (ratio by weight: 74/1.7/0.08) using a high shear Silverson mixer at 11,000 rpm for about 40 min. The final solids content of the dispersion is about 33% at a pH of 4.1. The dispersion is then formulated into the ink vehicle receiving layer (140) according to ratio listed in the table E using a blade mixer at 50° C. with very slow agitation to avoid air bubbling. All numbers are expressed in parts by weight.

TABLE E

| Ink colorant-receiving layer (140) | parts per weight |
|---|---|
| Disperal ® HP-14 (33 wt %) | 19 |
| Mowiol ® 40-88 | 2.8 |
| Zonyl ® FSN 100 | 0.1 |
| Silwet ® L7605 | 0.05 |
| Average pore size (nm) | 17 nm |

EXAMPLE 5

Printable Recording Media

Recording media, according to the present disclosure, and comparative media are prepared. Media (a) is a recording media such as described in the present disclosure. Media (b), (c), and (d) are comparative media. Each printable recording media includes a supporting substrate (110), a resin-rich barrier layer (120), a coating composition with bimodal pore size distribution (130) and an ink colorant receiving layer (140).

The resin-rich barrier layer (120), having the formulation illustrated in table A, is applied on one side of the supporting substrate (110) (having a basis weight of 220 gsm) using a pilot coater equipped with a smooth Meyer rod with a coating weight of about 5 gsm/side. The roll is then dried and further calendared using a lab calendaring machine under pressure 3000 PSI and at a temperature of about 200° F. The coating composition with bimodal pore size distribution (130) having the formulations as illustrated in TABLE D is then applied, using a pilot coater equipped with a Meyer rod device, on the image side of the media over the resin-rich barrier layer (120) with a coat weight of about 15 to about 25 gsm. The ink colorant receiving layer (140), having the formulation as illustrated in TABLE E, is applied over the ink vehicle receiving layer (130) with a slot die coater at a coat weight of about 0.3 gsm, in view of obtaining the recording media (a), (b), (c) and (d). The structure of the recording media: (a), (b), (c) and (d) are illustrated in the TABLE F below.

TABLE F

| Recording MEDIA structure: | (a) | (b) Comparative | (c) Comparative | (d) Comparative |
|---|---|---|---|---|
| supporting substrate (110) | 220 gsm | 220 gsm | 220 gsm | 220 gsm |
| resin-rich barrier layer (120) | 5 gsm | 5 gsm | — | 5 gsm |
| coating composition (130) | 18 gsm | 18 gsm | 18 gsm | Reverse charge clay only |
| Ink colorant receiving layer (140) | 0.3 gsm | — | 0.3 gsm | 0.3 gsm |

EXAMPLE 6

Printable Recording Material Performances

Ink compositions are prepared based on dispersions containing $Fe_3O_4$ nanoparticles. The dispersion is produced by milling $Fe_3O_4$ nanoparticle powder (Inframat Advanced Materials, Manchester, Conn.) in a Ultra Apex Mill® UAM-015 (Kotobuki Industries Co., LTD, Kure, Japan) with a dispersant, Silquest®A1230 at a dispersant/metal oxide particles ratio equal to 0.5. The resulting dispersion contains about 8 wt % or about 4.2 wt % of $Fe_3O_4$ particles. The average particle size of the $Fe_3O_4$ particles is about 25 nm or of about 35 nm, as measured by a Nanotrack® particle size analyzer (Microtrac Corp., Montgomeryville Pa.). The dispersion is then used to produce the ink compositions #1 and #2 as summarized in the TABLE G below. All numbers expressed the percentage per weight of each ingredient based on the total weight of the ink composition.

TABLE G

| Ink Formulation | #1# | #2# |
|---|---|---|
| $Fe_3O_4$ Dispersion (8 wt. %). Average particle size Mv = 25 nm | 24.8 | — |
| $Fe_3O_4$ Dispersion (4.2 wt. %) Average particle size Mv = 35 nm | — | 48 |
| LEG-1 | 5.00 | — |
| Dantocol ® DHE | — | 5.00 |
| 2-Pyrrolidinone | 9.00 | 9.00 |
| Trizma ® Base | 0.20 | 0.20 |
| Proxel ® GXL | 0.10 | 0.10 |
| Surfynol ® 465 | 0.20 | 0.20 |
| Water | Up to 100% | Up to 100% |

Ink compositions #1 and #2, as illustrated in TABLE G, are filled into HP print cartridge #94. Such ink compositions are applied, on the recording media (a), (b), (c) and (d), using a HP Photosmart 8540 printer (Hewlett Packard, Palo Alto Calif.). The printed articles are produced at ink flux density in the range of about 50 to about 125 pL/300th pixels.

The resulting printed articles are evaluated for their reflectance (R), their visual appearance, their ink load (at peak R) and for their bleeding and coalescence performances. The reflectance R, in percentage (%), is the percentage of reflectance on printed square versus the reflectance percentage on un-printed media (measured by a BYK reflectance meter), higher numbers illustrate better reflectance. The ink load, at peak R, represents the amount of ink that is necessary to obtain the best reflectance effect (smaller numbers illustrate better performances). The metallic appearance and the printing quality (ink bleed and coalescence) are evaluated visually. The results are summarized in TABLE H.

TABLE H

| MEDIA | R (%) | Ink load at peak R | Ink bleed/ coalescence | metalized appearance |
|---|---|---|---|---|
| (a) | 6.84 | 44.8 pL/300$^{th}$ | no | Excellent |
| (b) Comparative | 1.34 | 56 pL/300$^{th}$ | no | poor |

TABLE H-continued

| MEDIA | R (%) | Ink load at peak R | Ink bleed/ coalescence | metalized appearance |
|---|---|---|---|---|
| (c) Comparative | 2.5 | 44.8 pL/300$^{th}$ | No but poor gloss | moderate |
| (d) Comparative | 3.25 | 72.8 pL/300$^{th}$ | yes | poor |

It can be seen that the media according to the present disclosure shows the best metallic appearance as well as good performances in terms of bleed and gloss.

The invention claimed is:

1. A printable recording material, comprising:

a. an opaque supporting substrate;

b. a resin-rich barrier layer;

c. a coating composition with bimodal pore size distribution, wherein the coating composition includes primary permanently positive charged clay particles; and d. an ink colorant-receiving layer with inorganic particles.

2. The printable recording material of claim 1 wherein the opaque supporting substrate comprises inorganic fillers in an amount ranging from about 8 wt % to about 40 wt % by total weight of the supporting substrate.

3. The printable recording material of claim 1 wherein the opaque supporting substrate comprises a mixture of calcium carbonate and $TiO_2$ particles as inorganic fillers, said fillers being present in an amount representing more than about 15 wt % of the total weight of the supporting substrate.

4. The printable recording material of claim 1 wherein the resin-rich barrier layer includes from about 30 to about 80 wt % of polymer resin binders by total weight of the barrier layer.

5. The printable recording material of claim 1 wherein the coating composition with bimodal pore size distribution further includes:

secondary permanently positive charged particles;

a metallic salt; and a binder.

6. A printable recording material, comprising:

a. an opaque supporting substrate;

b. a resin-rich barrier layer;

c. a coating composition with bimodal pore size distribution, wherein the coating composition with bimodal pore size distribution encompasses primary permanently positive charged clay particles having a Z-potential in the range of about 5 to about 35 mV; and d. an ink colorant-receiving layer with inorganic particles.

7. The printable recording material of claim 1 wherein the primary permanently positive charged clay particles have a size in a range of about 0.2 to about 1.5 micrometers (μm).

8. The printable recording material of claim 1 wherein the coating composition with bimodal pore size distribution further includes secondary positive charged particles that are inorganic particles with an aggraded particle size in the range of about 10 to about 150 nanometers (nm).

9. The printable recording material of claim 1 wherein the coating composition with bimodal pore size distribution further includes permanently positive charged silica as a second type of pigment particles.

10. The printable recording material of claim 1 wherein the ink colorant-receiving layer contains inorganic particles that can be selected from the group consisting of aluminum oxide ($Al_2O_3$), silicon dioxide ($SiO_2$), nanocrystalline boehmite alumina (AlO(OH)) and aluminum phosphate ($AlPO_4$).

11. A method for making a printable recording material, comprising:

a. providing an opaque supporting substrate;

b. applying a resin-rich barrier layer, a coating composition with bimodal pore size distribution, wherein the coating composition includes primary permanently positive charged clay particles; and an ink colorant-receiving layer comprising inorganic particles on top of said layers; and c. drying and calendaring said layers.

12. The method of claim 11, further comprising applying an ink composition onto the printable recording material, wherein the ink composition is a metalized ink composition that encompasses dispersed metal oxide particles.

13. A printed article obtained according to the method of claim 12, comprising:

a. the printable recording material containing the opaque supporting substrate; the resin-rich barrier layer; the coating composition with bimodal pore size distribution, wherein the coating composition includes primary permanently positive charged clay particles; and the ink colorant-receiving layer with inorganic particles; and b. a printed feature applied on top of said printable recording material.

14. The printable recording material of claim 6 wherein the opaque supporting substrate comprises inorganic fillers in an amount ranging from about 8 wt % to about 40 wt % by total weight of the supporting substrate.

15. The printable recording material of claim 6 wherein the opaque supporting substrate comprises a mixture of calcium carbonate and $TiO_2$ particles as inorganic fillers, said fillers being present in an amount representing more than about 15 wt % of total weight of the supporting substrate.

16. The printable recording material of claim 6 wherein the resin-rich barrier layer includes from about 30 to about 80 wt % of polymer resin binders by total weight of the barrier layer.

17. The printable recording material of claim 6 wherein the coating composition with bimodal pore size distribution further includes:

secondary permanently positive charged particles;

a metallic salt; and a binder.

18. The printable recording material of claim 6 wherein the primary permanently positive charged clay particles have a size in a range of about 0.2 to about 1.5 micrometers (μm).

19. The printable recording material of claim 6 wherein the coating composition with bimodal pore size distribution further includes secondary positive charged particles that are inorganic particles with an aggraded particle size in the range of about 10 to about 150 nanometers (nm).

20. The printable recording material of claim 6 wherein the coating composition with bimodal pore size distribution further includes permanently positive charged silica as a second type of pigment particles.

* * * * *